US012268343B2

(12) United States Patent
Park

(10) Patent No.: US 12,268,343 B2
(45) Date of Patent: Apr. 8, 2025

(54) CEILING-MOUNTED SHOWER BOOTH

(71) Applicant: Jong-Eun Park, Seoul (KR)

(72) Inventor: Jong-Eun Park, Seoul (KR)

( * ) Notice: Subject to any disclaimer, the term of this patent is extended or adjusted under 35 U.S.C. 154(b) by 189 days.

(21) Appl. No.: 18/132,483

(22) Filed: Apr. 10, 2023

(65) Prior Publication Data

US 2023/0320537 A1 Oct. 12, 2023

(30) Foreign Application Priority Data

Apr. 7, 2022 (KR) ..... 20-2022-0000852

(51) Int. Cl.

| | |
|---|---|
| ***A47K 3/06*** | (2006.01) |
| ***A47K 3/32*** | (2006.01) |
| ***A47K 3/38*** | (2006.01) |
| ***A47K 3/40*** | (2006.01) |

(52) U.S. Cl.

CPC ..... *A47K 3/06* (2013.01); *A47K 3/32* (2013.01); *A47K 3/38* (2013.01); *A47K 3/40* (2013.01)

(58) Field of Classification Search

CPC ... A47K 3/06; A47K 3/32; A47K 3/38; A47K 3/40; E04H 15/04

USPC ... 4/607, 612, 613, 557, 558, 548, 584, 585, 4/599

See application file for complete search history.

(56) References Cited

U.S. PATENT DOCUMENTS

| | | | | |
|---|---|---|---|---|
| 477,515 | A * | 6/1892 | Cox et al. | A47K 3/325 4/599 |
| 844,220 | A * | 2/1907 | Westbrooke | E04H 15/04 135/120.2 |
| 2015/0113722 | A1* | 4/2015 | Darasch | A47K 3/32 4/599 |

FOREIGN PATENT DOCUMENTS

| | | |
|---|---|---|
| KR | 2002028920000 | 8/2000 |
| KR | 20160059786 | 5/2016 |
| KR | 20190063802 | 6/2019 |

* cited by examiner

*Primary Examiner* — Tuan N Nguyen
(74) *Attorney, Agent, or Firm* — IPLA P.A.

(57) ABSTRACT

A ceiling-mounted shower booth includes: an upper frame unit mounted on top of an installation space; a lower bottom unit located under the upper frame unit and having an accommodation space whose top is open formed therein to accommodate water falling down thereabove; and an ascending and descending unit adapted to selectively move the lower bottom unit so that the lower bottom unit becomes close to and distant from the upper frame unit.

1 Claim, 11 Drawing Sheets

CEILING-MOUNTED SHOWER BOOTH

CROSS REFERENCE

The present application claims the benefit of Korean Patent Application No. 20-2022-0000852 filed in the Korean Intellectual Property Office on 7 Apr. 2022, the entire contents of which are incorporated herein by reference.

BACKGROUND

The present invention relates to a ceiling-mounted shower booth that is mounted on top (e.g., ceiling) of a facility made for a user's living, such as a mobile vehicle (e.g., a camper, a trailer, a caravan, etc.), a temporary facility (e.g., a temporary house, a container type house, etc.), and the like to provide a space in which he or she takes a shower if necessary.

In specific, the present invention relates to a ceiling-mounted shower booth that is normally kept in a state of being folded to top of a facility and descendingly locates a lower bottom unit on bottom of the facility if necessary, while a shower space is being closed from the outside.

In more specific, the present invention relates to a ceiling-mounted shower booth that is simple in configuration and light in weight, thereby ensuring many economical advantages and high usability in living space.

Generally, a bathtub and a shower are disposed in a bathroom of a residential facility (e.g., house, hotel, studio apartment, or middle or large-sized apartment), so that a user can take a shower in the bathroom.

Recently, it is most desired to change a bathtub to a shower booth when houses are renovated, which is a growing trend.

Even in mixed-use apartment buildings that become popular, these days, shower booth is one of basic specifications or options.

One of the reasons why the installation of the shower booth increases is because the bathroom serving as a sanitary space is gradually expanded as a resting space.

Instead of bathtubs decreasing in the number of times used, accordingly, shower booths are increasingly installed.

The shower booth has many advantages, and firstly, the shower booth can be installed in a smaller space than the bathtub that occupies a relatively large area.

As a result, the available area of the bathroom can increase.

Secondly, water does not splash so that the bathroom can be always used as a fresh space having no moisture.

Lastly, if the shower booth is constructed when a bathroom work is entirely done, a construction cost can be saved.

The shower booth is provided to the form of a general box-shaped structure, a sliding door structure, a entirely safe tempered glass structure fixed by hinges, a partition type structure, or the like, and further, the shower booth is provided to the form of a storage type shower booth that rotates around a shaft, if it is desired to use a bathroom sink and a dressing table, to expose the bathroom sink and the dressing table to the outside, and rotates around the shaft, if it is desired that the bathroom sink and the dressing table are not used, to introducedly store them therein.

Further, mobile temporary shower booths, which are simply and quickly installed on places where outdoor activities as well as sports games are frequently taken and on construction sites, have been proposed and used to allow a user to take a shower therein.

One of conventional technologies relating to shower booths is disclosed in Korean Utility Model Application No. 20-2003-0038843 (Entitled 'Sliding shower booth'/Dated Dec. 12, 2003), and the conventional sliding shower booth as disclosed, which is configured to have horizontal support bars on which guide rails are disposed connected to both side walls of a bathroom, to have tempered glass plates standingly fixed to one side of the horizontal support bars and one side corresponding to the floor of the bathroom, and to have rollers fitted to the guide rails through support holders of top of an entrance door to allow the entrance door to run in a state of being suspended on the support bars, includes a guide rod on which a transfer guide groove is formed fixedly installed on the floor of the bathroom corresponding to a portion of a bottom path of the entrance door, a vertical support bar on which a parking guide groove is formed fixedly installed on the side wall of the bathroom where the entrance door is closed, and mohair fixedly disposed on both inner walls of at least one of the transfer guide groove and the parking guide groove and frictionally contacting with the entrance door.

Another conventional technology is disclosed in Korean Utility Model Application No. 20-2008-0015284 (Entitled 'Emergency temporary shower booth'/Dated Nov. 17, 2008), and the conventional emergency temporary shower booth as disclosed, which is installed simply in a place where a frost proof yard hydrant is located, includes: a plurality of upper frames having a rectangular shape; a plurality of vertical frames connected perpendicularly and downward from the corners of the upper frames; a rectangular lower frame connected to the lower ends of the vertical frames and having a drain hole protruding from one side thereof; side plates attached to both sides of the front and rear vertical frames; and a back plate attached to the space between the rear side vertical frames. In this case, the lower frame is configured to allow a finish plate to be unitarily attached to the underside thereof to keep watertightness, and the side and back plates are made of a synthetic resin capable of preventing light from passing therethrough.

Yet another conventional technology is disclosed in Korean Utility Model Application No. 20-2002-0026801 (Entitled 'Bathtub having function of shower booth'/Dated Sep. 6, 2002), and the conventional bathtub having a function of a shower booth as disclosed is configured to have shock absorbers vertically standing up manually or automatically on both sides of a bathtub and a shower mounted inclined to a given angle on the free end side of the bathtub to spray water forward when the bathtub stands vertically, so that if the bathtub is placed horizontally, it has an original function thereof, and if the bathtub stands vertically, it has a function of the shower booth.

Still another conventional technology is disclosed in Korean Patent Application Laid-open No. 10-2014-0077668 (Entitled 'Shower booth adopting rotary storage'/Dated Jun. 24, 2014), and the conventional shower booth adopting rotary storage as disclosed, which has a door mounted on one side thereof and a shower fixed to one side thereof or held by a user's hand when he or she showers, includes: a casing providing a given independent space; a fixing member disposed on one side wall of the interior of the casing; the shower fixed to the fixing member; and a storage device disposed on one side of the interior of the casing and having a plurality of drawers and a washstand stored in a first space portion formed under the drawers and thus rotatable by a physical force applied from the outside.

However, the conventional shower booths have structures in which it is hard that they are applied to mobile vehicles (e.g., a camper, a trailer, a caravan, etc.), thereby resulting in the limitations in use.

Moreover, the spaces occupied by the conventional shower booths are planar spaces on installation spaces, thereby causing the user's living space to be invaded.

That is, the space in which the user lives becomes reduced, thereby causing the limitations in use.

SUMMARY OF THE INVENTION

Accordingly, the present invention has been made in view of the above-mentioned problems occurring in the related art, and it is an object of the present invention to provide a ceiling-mounted shower booth that is capable of being mounted on top (e.g., ceiling) of a facility in which a user lives, such as a mobile vehicle (e.g., a camper, a trailer, a caravan, etc.), a temporary facility (e.g., a temporary house, a container type house, etc.), and the like to provide a space in which he or she takes a shower if necessary, so that the ceiling-mounted shower booth is normally kept in a state of being folded to top of the facility and descendingly locates a lower bottom unit on bottom of the facility if necessary, while a shower space is being closed from the outside.

It is another object of the present invention to provide a ceiling-mounted shower booth that is capable of being simple in configuration and light in weight, thereby ensuring many economical advantages and high usability in living space.

To accomplish the above-mentioned objects, according to the present invention, there is provided a ceiling-mounted shower booth including: an upper frame unit mounted on top of an installation space; a lower bottom unit located under the upper frame unit and having an accommodation space whose top is open formed therein to accommodate water falling down thereabove; and an ascending and descending unit adapted to selectively move the lower bottom unit so that the lower bottom unit becomes close to and distant from the upper frame unit.

According to the present invention, desirably, the ascending and descending unit may include: ascending and descending wires whose ends are fastened to the lower bottom unit and passing through the upper frame unit; an ascending and descending wire winding drum for winding the ascending and descending wires thereon; and an ascending and descending member for selectively rotating the ascending and descending wire winding drum forward and backward to allow the ascending and descending wires to be wound and unwound on and from the ascending and descending wire winding drum.

According to the present invention, desirably, the lower bottom unit may include a shower pan open on top thereof and having the accommodation space formed therein and a drain hole formed on a given position thereof to drain the water to the outside, the shower pan being formed more curvedly upward from the center thereof than the corners thereof.

According to the present invention, desirably, the ceiling-mounted shower booth may further include a closing curtain unit having curtains movably fastened to the upper frame unit to close the space between the upper frame unit and the lower bottom unit from the outside.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
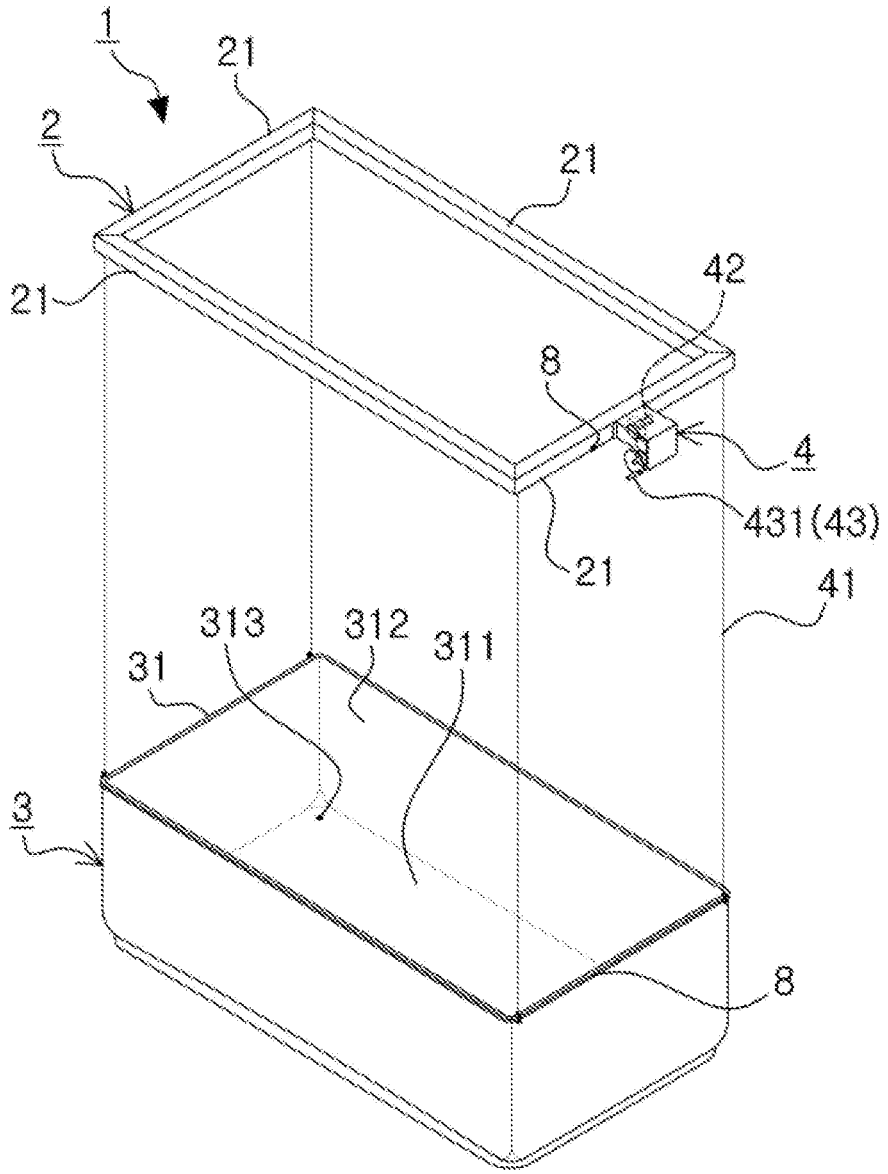
FIG. 1 is a schematic perspective view showing a ceiling-mounted shower booth according to an embodiment of the present invention.
Figure 2:
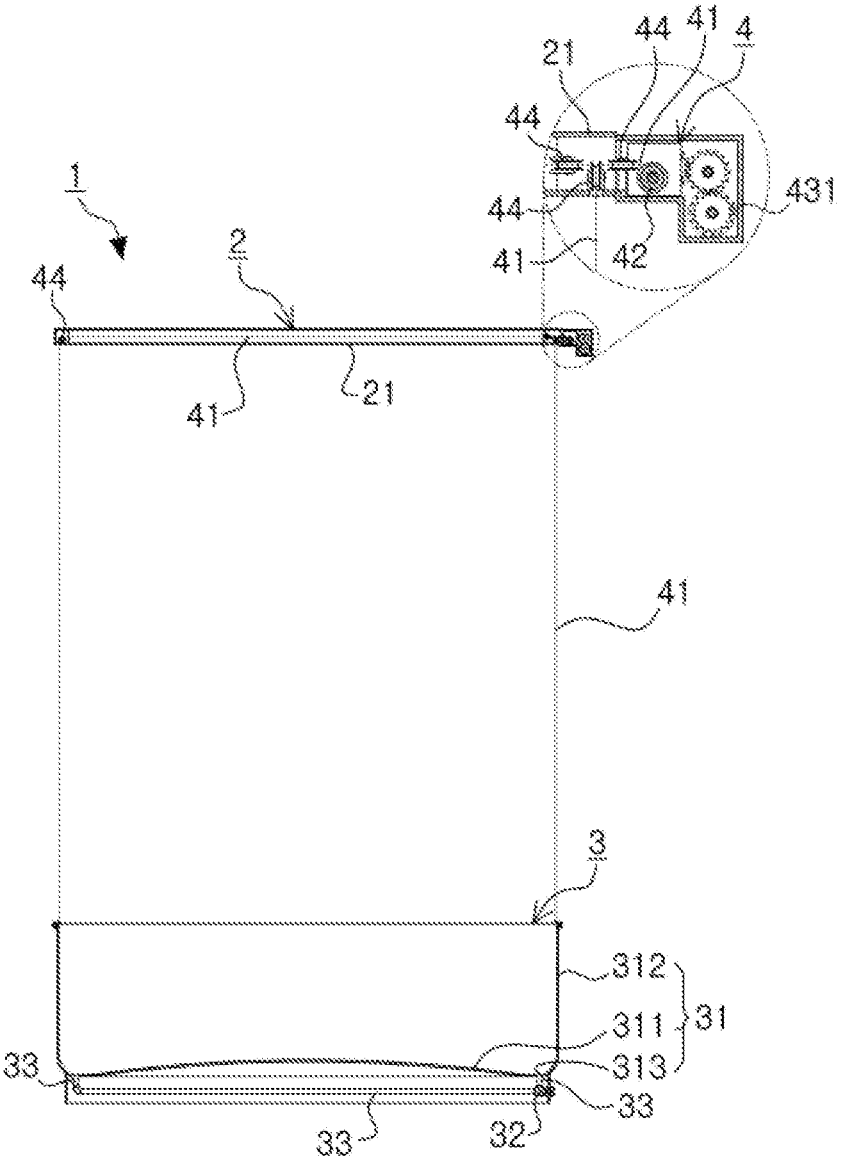
FIG. 2 is a schematic side sectional view showing the ceiling-mounted shower booth according to the embodiment of the present invention.
Figure 3:
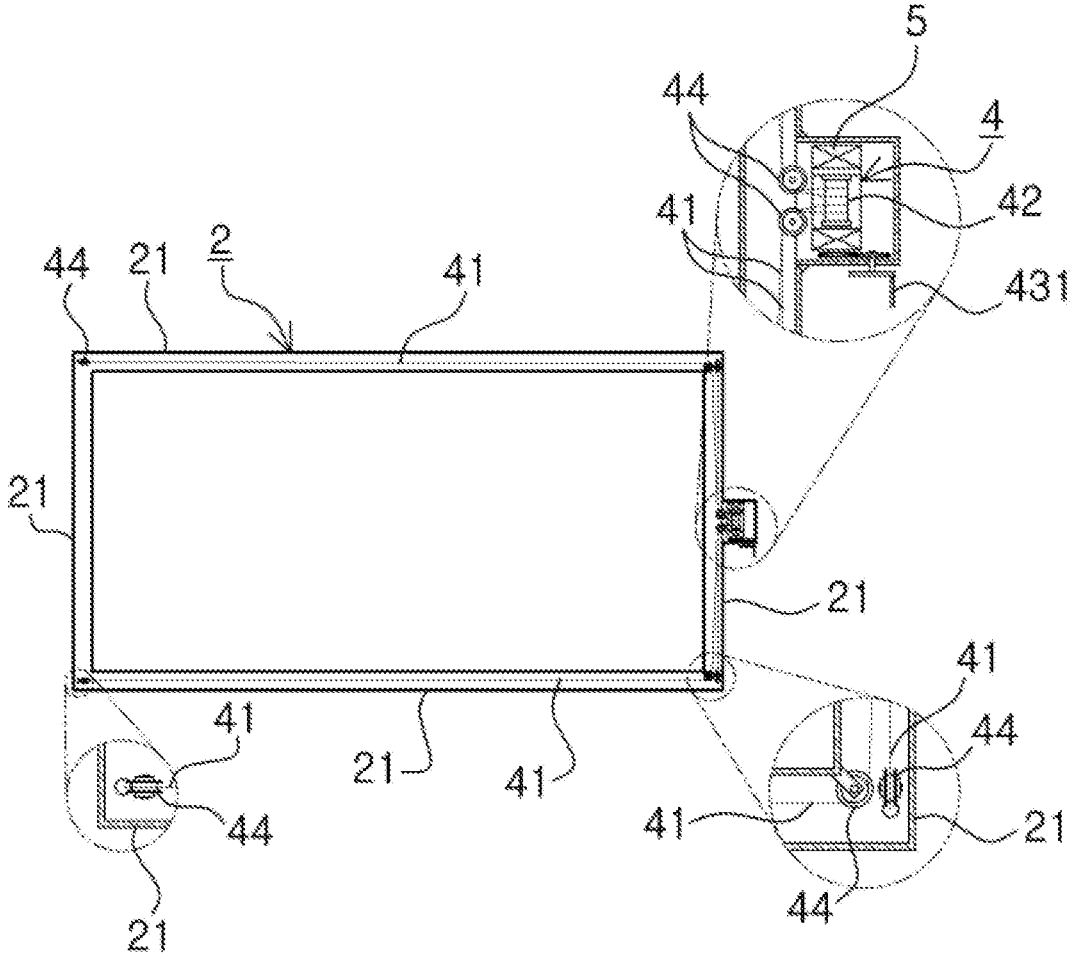
FIG. 3 is a schematic plan sectional view showing an upper frame unit and an ascending and descending unit of the ceiling-mounted shower booth according to the embodiment of the present invention.
Figure 4:
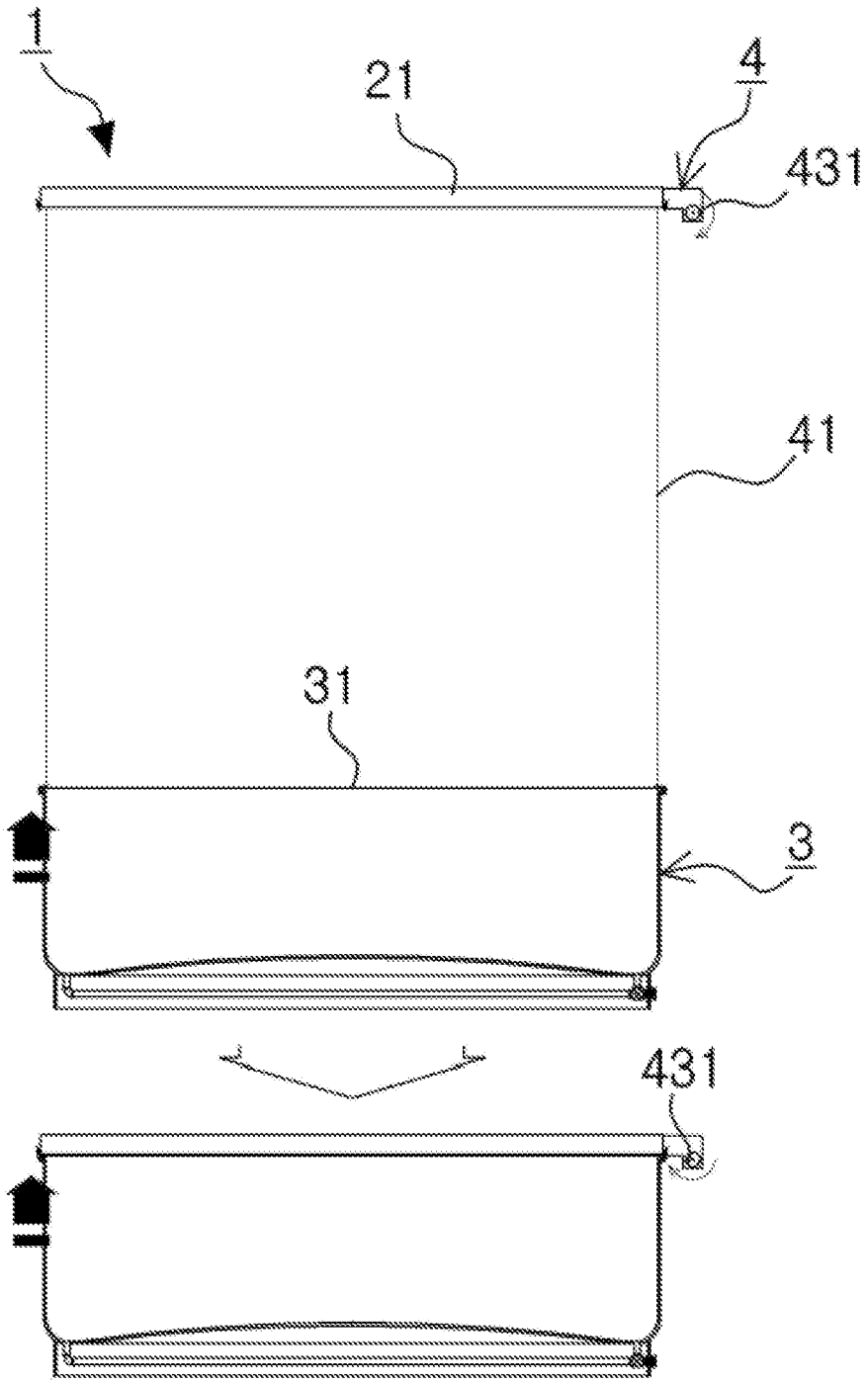
FIG. 4 is a schematic exemplary view showing an operating state of the ascending and descending unit of the ceiling-mounted shower booth according to the embodiment of the present invention.
Figure 5:
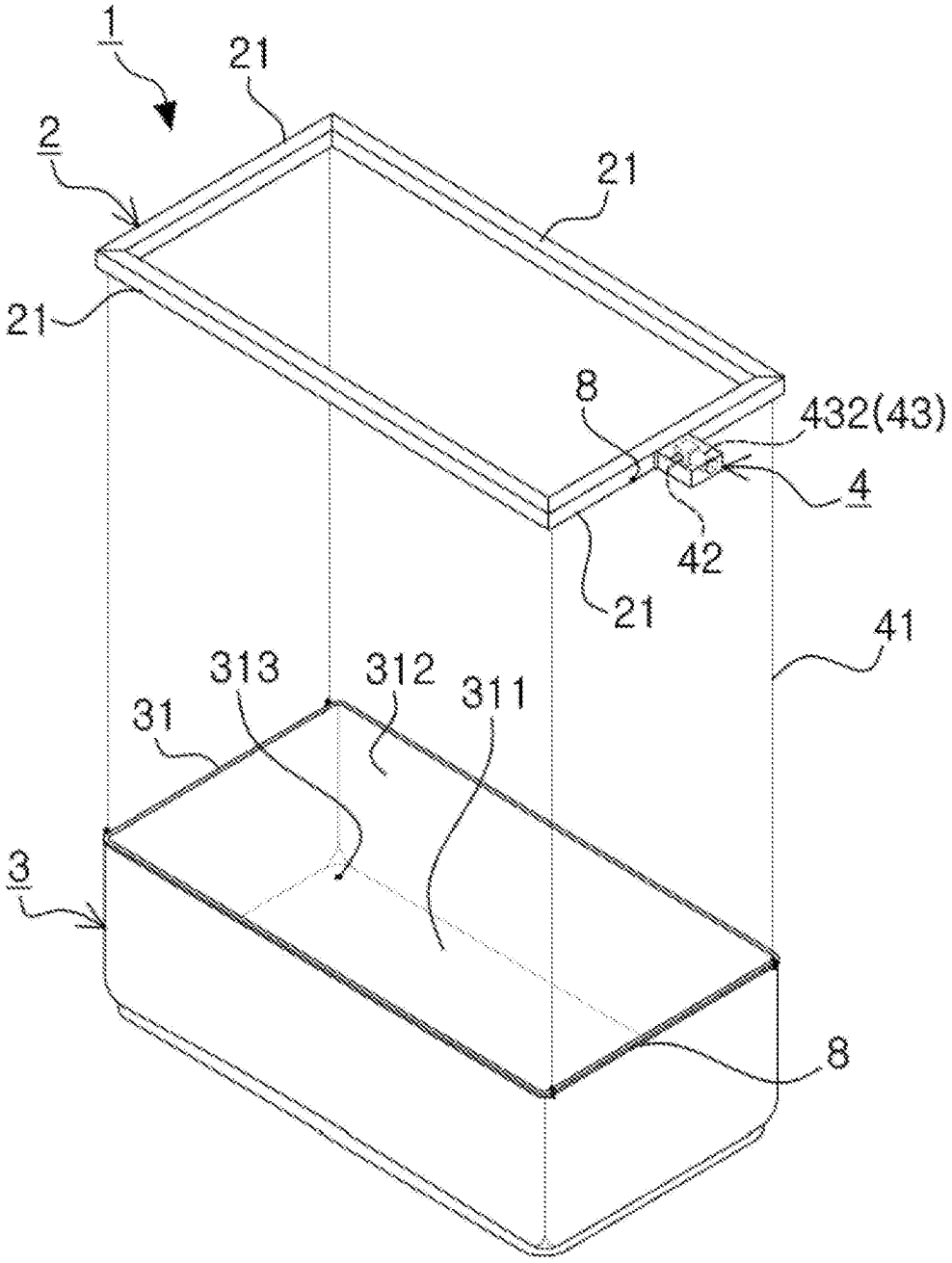
FIGS. 5 to 7 are schematic exemplary views showing other examples of the ascending and descending unit of the ceiling-mounted shower booth according to the embodiment of the present invention.
Figure 6:
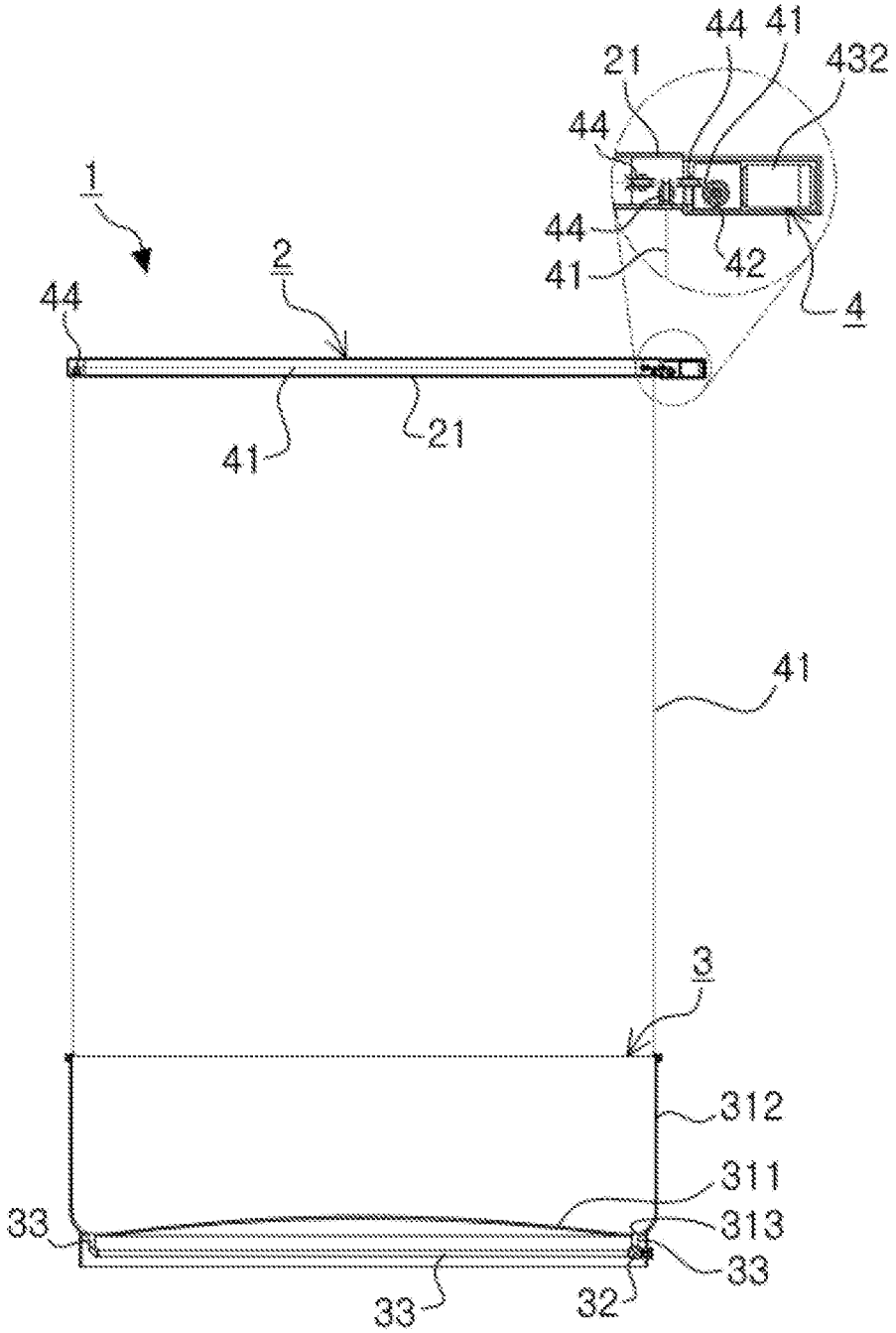
Figure 7:
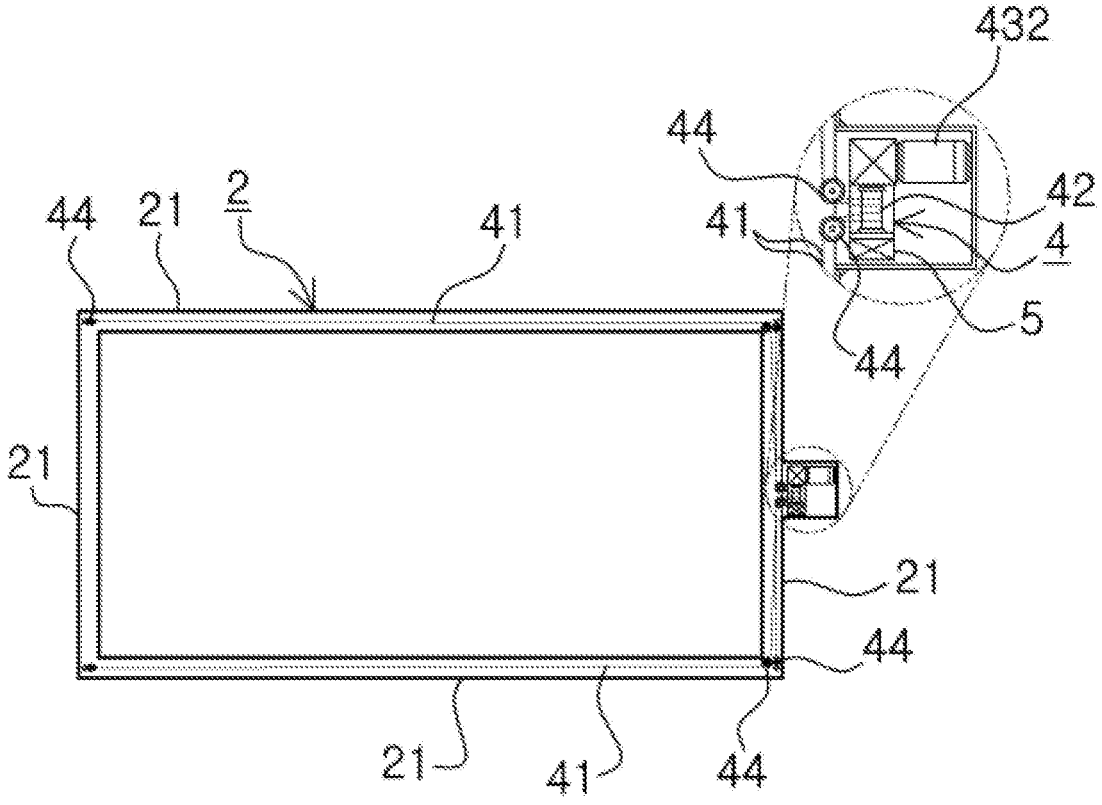
Figure 8:
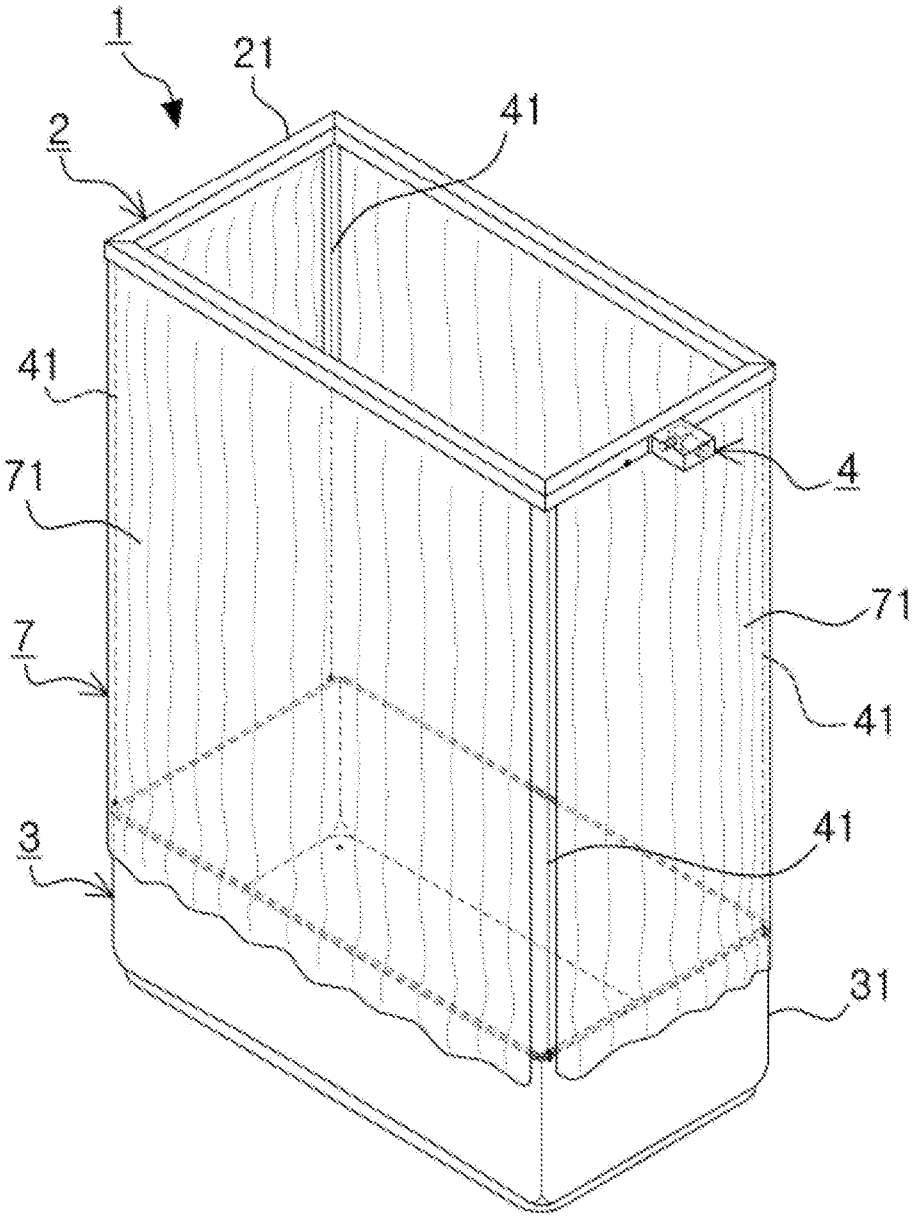
FIGS. 8 and 9 are schematic exemplary views showing a closing curtain member of the ceiling-mounted shower booth according to the embodiment of the present invention.
Figure 9:
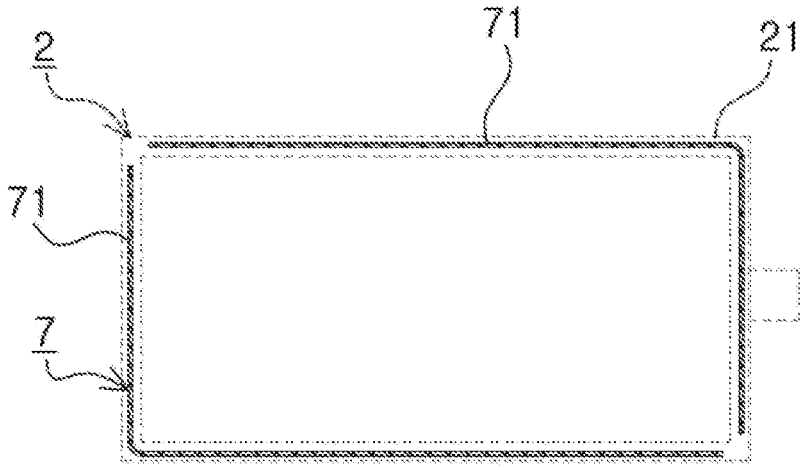
Figure 10:
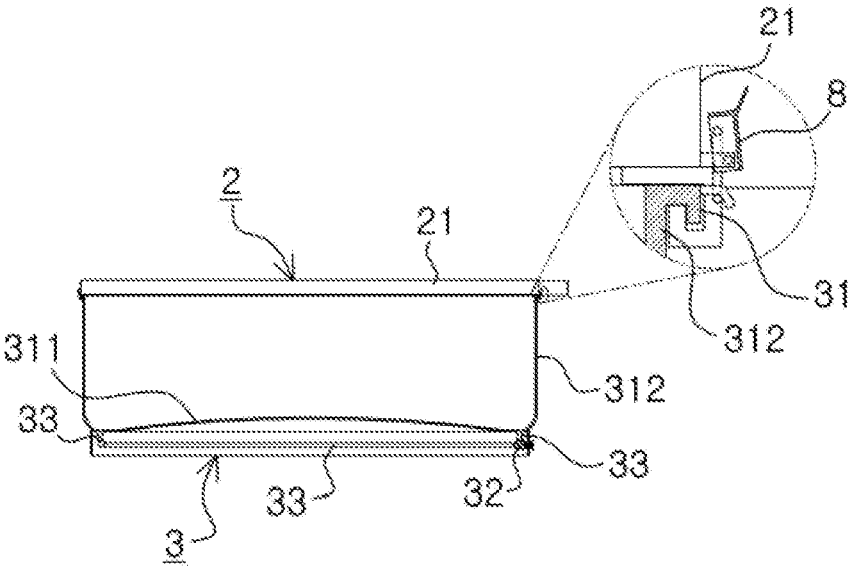
FIG. 10 is a schematic exemplary view showing a main locking member of the ceiling-mounted shower booth according to the embodiment of the present invention.
Figure 11:
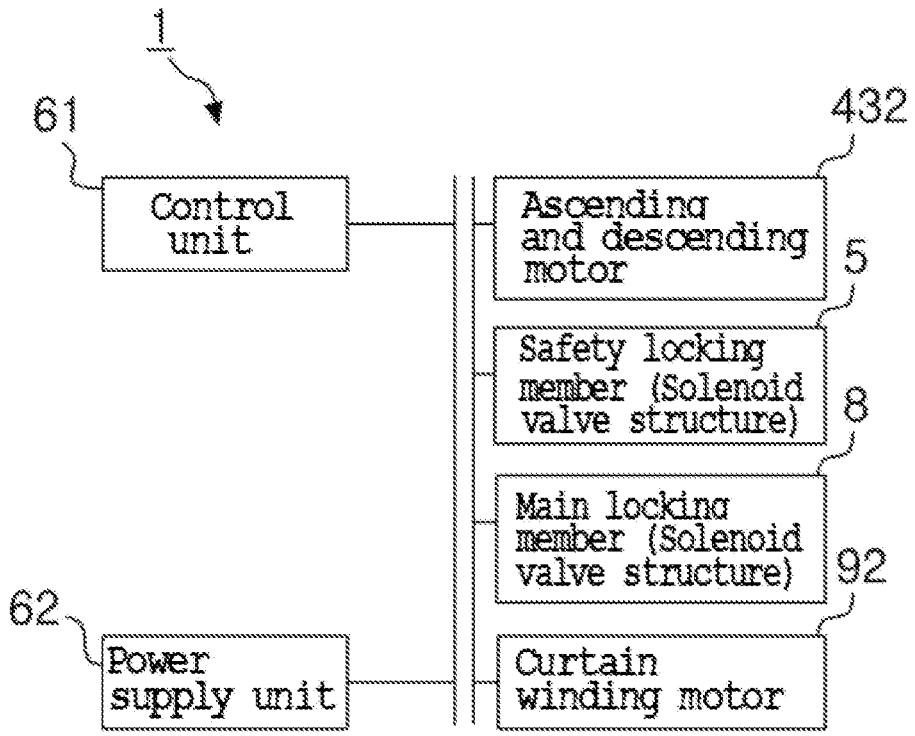
FIG. 11 is a block diagram showing a state of controlling the ceiling-mounted shower booth according to the embodiment of the present invention.

Now, an explanation of a ceiling-mounted shower booth according to the present invention will be given with reference to the attached drawings.

Before the present invention is disclosed and described, it is to be understood that the disclosed embodiments are merely exemplary of the invention, which can be embodied in various forms. Those skilled in the art will envision many other possible variations within the scope of the present invention. In the description, the thicknesses of the lines or the sizes of the components shown in the drawing may be magnified for the clarity and convenience of the description. The corresponding parts in the embodiments of the present invention are indicated by corresponding reference numerals. If it is determined that the detailed explanation on the well known technology related to the present invention makes the scope of the present invention not clear, the explanation will be avoided for the brevity of the description.

FIGS. 1 to 11 show a ceiling-mounted shower booth 1 according to an embodiment of the present invention, and the ceiling-mounted shower booth 1 according to the embodiment of the present invention is mounted on top (e.g., ceiling) of a facility in which a user lives, such as a mobile vehicle (e.g., a camper, a trailer, a caravan, etc.), a temporary facility (e.g., a temporary house, a container type house, etc.), and the like to provide a space in which he or she takes a shower if necessary and to be normally stored separately from his or her living space, thereby causing no invasion in his or her living space and activities.

In specific, normally, the ceiling-mounted shower booth 1 is foldedly stored on top (the ceiling of a mobile vehicle or the ceiling of a temporary facility) of an installation space separated from the user's living space, and if necessary, further, the ceiling-mounted shower booth 1 is unfolded to provide a shower space in which he or she takes a shower stably.

The ceiling-mounted shower booth 1 according to the embodiment of the present invention includes: an upper frame unit 2 mounted on top of the installation space; a lower bottom unit 3 located under the upper frame unit 2 and having an accommodation space whose top is open formed therein to accommodate water falling down thereabove; and an ascending and descending unit 4 adapted to selectively move the lower bottom unit 3 so that the lower bottom unit 3 becomes close to and distant from the upper frame unit 2.

In specific, the lower bottom unit 3 is supportedly connected to the underside of the upper frame unit 2 through the ascending and descending unit 4, and according to the user's selection, of course, the lower bottom unit 3 is ascended and thus close to the upper frame unit 2 through the ascending and descending unit 4, so that as the upper frame unit 2 and the lower bottom unit 3 are foldedly laminated on top of the facility, the space below them becomes empty, thereby minimizing the space occupied by the ceiling-mounted shower booth 1.

If it is desired to provide the shower space, moreover, the lower bottom unit 3 is descended and thus distant from the upper frame unit 2 toward the bottom of the installation space through the ascending and descending unit 4 according to the user's selection, so that the shower space is provided between the upper frame unit 2 and the lower bottom unit 3.

As a result, normally, the upper frame unit 2 and the lower bottom unit 3 are tightly laminated and thus foldedly stored on top of the facility, and if necessary, further, the lower bottom unit 3 is located on the bottom of the facility to thus provide the shower space in the shower booth.

Accordingly, the space occupied normally by the installation space in the living space on plane is not generated, thereby optimizing the use efficiency of the living space.

The upper frame unit 2 is provided by coupling frame pipes 21 whose interiors are hollow as square pipes whose sectional shapes are square to one another, and the structures and configurations of the frame pipes 21 may be appropriately selected and adopted by the user from conventional known technologies.

The upper frame unit 2 is fixed to the facility by means of fixing elements such as anchor bolts, and the structures and configurations of the fixing elements may be appropriately selected and adopted by the user from conventional known technologies.

The lower bottom unit 3 of the ceiling-mounted shower booth 1 includes a shower pan 31 whose top is open and having a sectional shape of '⊔' to thus have the accommodation space formed therein.

In specific, the shower pan 31 is a place on which the user steps to take a shower.

The shower pan 31 has a rectangular shape corresponding to the outer shape of the upper frame unit 2 on plane and is thus appropriately adopted according to the user's selection.

The shower pan 31 includes: a bottom plate 311 having a horizontal width; and side plates 312 bentedly extending upward from the edges of the bottom plate 311.

In specific, the accommodation space is formed by connecting the bottom plate 311 and the side plates 312.

The bottom plate 311 is formed more curvedly upward from the center thereof than the edges thereof to allow water falling down to be induced to the edges thereof, and further, the shower pan 31 includes a drain hole 313 formed on one side corner of the bottom plate 311 to drain the water to the outside.

In specific, the water accommodated in the accommodation space is drained to the outside through the drain hole 313 and thus treated appropriately.

Further, a drain valve 32 and a drain pipe 33, which are open and closed according to the user's selection, are connected to the drain hole 313 to selectively drain the water accommodated in the accommodation space to the outside if necessary, and the structures and configurations of the drain valve 32 and the drain pipe 33 may be appropriately selected and adopted by the user from conventional known technologies.

The ascending and descending unit 4 of the ceiling-mounted shower booth 1 according to the embodiment of the present invention includes: ascending and descending wires 41 having ends fastened to the lower bottom unit 3 and passing through the upper frame unit 2; an ascending and descending wire winding drum 42 for winding the ascending and descending wires 41 thereon; and an ascending and descending member 43 for selectively rotating the ascending and descending wire winding drum 42 forward and backward to allow the ascending and descending wires 41 to be unwound and wound from and on the ascending and descending wire winding drum 42.

In specific, the ascending and descending wires 41 having the ends fixed to the shower pan 31 of the lower bottom unit 3 pass through the frame pipes 21 of the upper frame unit 2 and are thus wound on the ascending and descending wire winding drum 42.

As a result, when the ascending and descending wire winding drum 42 rotates forward and backward by means of the ascending and descending member 43, the ascending and descending wires 41 are wound and unwound on and from the ascending and descending wire winding drum 42 to allow the shower pan 31 to be ascended and descended to and from the upper frame unit 2, so that the shower pan 31 becomes close to and distant from the upper frame unit 2.

The ascending and descending wires 41 move in the interiors of the frame pipes 21 and are thus wound on the ascending and descending wire winding drum 42. In this case, the frame pipes 21 have a plurality of guide rollers 44 located therein to inducedly guide the ascending and descending wires 41.

In specific, the ascending and descending wires 41 are guided through the guide rollers 44 and thus wound on the ascending and descending wire winding drum 42.

Further, the ascending and descending wires 41 are provided with four wires 41 in one set that have ends fixed to four corners of the side plates 312 of the shower pan 31, and the respective ascending and descending wires 41 are introduced into the four corners of the upper frame unit 2 and guided by the guide rollers 44.

As a result, the four corners of the shower pan 31 are simultaneously ascended and descended, thereby ensuring structural stability upon the ascending and descending operations.

The ascending and descending member 43 is connected to a rotary shaft of the ascending and descending wire winding drum 42 and provided to the form of a manual handle 431 taken by the user's hand to manually rotate the ascending and descending wire winding drum 42 forward and backward. Otherwise, the ascending and descending member 43 is provided to the form of an ascending and descending motor 432 selectively driven under the control of a control unit 61 for controlling the power of a power supply unit 62 to thus generate a rotary force so that the rotary shaft of the ascending and descending wire winding drum 42 rotates forward and backward. In this case, the ascending and descending member 43 is appropriately adopted according to the user's selection.

Further, a safety locking member 5 is mounted on the ascending and descending wire winding drum 42 to prevent the ascending and descending wire winding drum 42 from unintentionally rotating when the ascending and descending wire winding drum 42 stops.

In specific, the ascending and descending wire winding drum 42 can be prevented from unintentionally rotating through the safety locking member 5, thereby achieving high structural stability.

The safety locking member 5 is provided to the form of a latch gear structure in which it can be unlocked and locked manually by the user, a button type locking structure in which it linearly moves and is thus unlocked and locked through the elastic force of a spring, or a solenoid valve structure in which it selectively receives the power under the control of the control unit 61 and is thus unlocked and locked. In this case, the safety locking member 5 may be appropriately adopted according to the user's selection.

The ceiling-mounted shower booth 1 according to the present invention further includes a closing curtain unit 7 having curtains 71 movably fastened to the upper frame unit 2 to close the space between the upper frame unit 2 and the lower bottom unit 3 from the outside.

In specific, the shower space formed between the upper frame unit 2 and the shower pan 31 is closed from the outside through the closing curtain unit 7, thereby improving the conveniences of the user.

The curtains 71 are made of a flexible material and foldable upon the ascending and descending operations of the shower pan 31, and the materials and configurations of the curtains 71 may be appropriately selected and adopted by the user from conventional known technologies.

Further, the closing curtain unit 7 is provided with two curtains 71 in one set, and top of each curtain 71 is fixed foldable horizontally to the upper frame unit 2. The connection structures and configurations of the curtains 71 to the upper frame unit 2 may be appropriately selected and adopted by the user from conventional known technologies.

The closing curtain unit 7 has an entrance opening open and closed vertically, and through the entrance opening, the user can easily enter the shower space.

The entrance opening of the closing curtain unit 7 is formed by an opening and closing structure open and closed by the user, and otherwise, the entrance opening may be formed by a loop locking structure, a clamp structure, a snap button structure, a zipper structure, a Velcro tape structure, and the like. The structure of the entrance opening may be appropriately selected and adopted by the user from conventional known technologies.

The opening and closing structure is provided on the facing sides of the curtains 71.

In a process where the upper frame unit 2 and the shower pan 31 are folded, accordingly, the curtains 71 are accommodated into the shower pan 31 and thus bent vertically stably.

The ceiling-mounted shower booth 1 according to the present invention further includes a main locking member 8 adapted to maintain a state where the upper frame unit 2 and the shower pan 31 are close to each other.

In specific, the shower pan 31 is fixedly locked onto the upper frame unit 2 through the main locking member 8.

Accordingly, the shower pan 31 is prevented from unintentionally moving, thereby ensuring high structural stability.

In the case of the mobile vehicle, the shower pan 31 is prevented from unintentionally falling due to vibration loads caused by the vehicle driven, thereby avoiding the occurrence of safety accidents.

The main locking member 8 may have a solenoid valve structure, a clamp structure, or the like that selectively receives power under the control of the control unit 61 and is thus unlocked and locked, and the structure and configuration of the main locking member 8 may be appropriately selected and adopted by the user from conventional known technologies.

Figure 12:
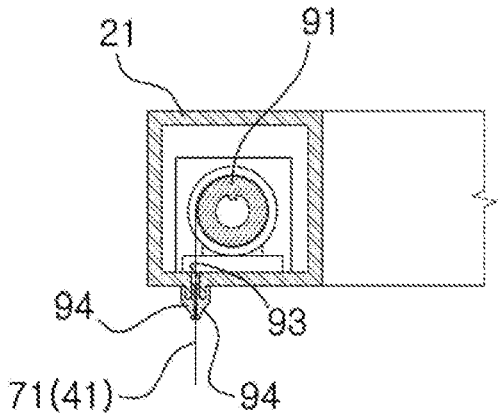
FIGS. 12 and 13 are schematic exemplary views showing a ceiling-mounted shower booth according to another embodiment of the present invention.
Figure 13:
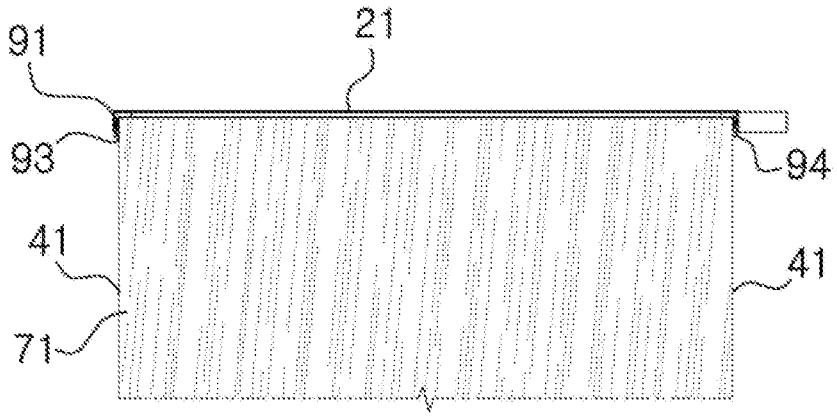

FIGS. 12 and 13 show a ceiling-mounted shower booth 1 according to another embodiment of the present invention, and the ceiling-mounted shower booth 1 according to another embodiment of the present invention is configured to allow curtains 71 to which ascending and descending wires 41 are sewn to be ascended and descended in the same directions along which the ascending and descending wires 41 are ascended and descended, to have curtain winding drums 91 disposed in the interiors of the frame pipes 21 to wind the curtains 71 to which the ascending and descending wires 41 are sewn thereon, and to have curtain winding motors 92 disposed in the interiors of the frame pipes 21 to selectively receive power under the control of the control unit 61, rotate the curtain winding drums 91 forward and backward, and thus unwind and wind the ascending and descending wires 41 and the curtains 71 wound on the curtain winding drums 91.

In specific, the curtain winding motors 92 selectively operate under the control of the control unit 61 to thus wind or unwind the ascending and descending wires 41 and the curtains 71 on and from the curtain winding drums 91, so that the ascending and descending wires 41 and the curtains 71 enter the frame pipes 21.

The frame pipes 21 each have an introduction opening 93 adapted to pass the corresponding ascending and descending wire 41 and the corresponding curtain 71 therethrough, and a water removal filter 94 is disposed on the introduction opening 93 to suckedly or pushedly remove the water remaining on the corresponding curtain 71 when the curtain 71 enters the introduction opening 93.

In specific, in the process where the curtain 71 passes through the introduction opening 93 and thus enters the corresponding frame pipe 21, water remaining on the curtain 71 is removed through the water removal filter 94, thereby ensuring high structural stability.

The water removal filter 94 is provided to the form of a sponge pad, a squeegee rubber plate, or the like to thus suckedly or pushedly remove water, and the structure and configuration of the water removal filter 94 may be appropriately selected and adopted by the user from conventional known technologies.

The curtain winding drums 91, the curtain winding motors 92, the introduction openings 93, and the water removal filters 94 are located correspondingly to the respective frame pipes 21 of the upper frame unit 2.

As described above, the ceiling-mounted shower booth 1 according to the present invention is normally stored in a state where the upper frame unit 2 and the lower bottom unit 3 are folded to each other on top of the facility, descends the lower bottom unit 3 from the upper frame unit 2 through the ascending and descending unit 4, if necessary, to allow the lower bottom unit 3 to be located on bottom of the facility to form the shower space, and simultaneously unfolds the closing curtain unit 7 to close the shower space from the outside.

Further, the ceiling-mounted shower booth according to the present invention is simple in configuration and light in weight so that it can be stably applied to a mobile vehicle (e.g., a camper, a trailer, a caravan, etc.), a temporary facility (e.g., a temporary house, a container type house, etc.), and the like, thereby ensuring many economical advantages and high usability in living space.

Additionally, the ceiling-mounted shower booth according to the present invention is normally stored in a state of being folded to top (e.g., ceiling) of the facility and descendingly locates the lower bottom unit on bottom of the facility if necessary, while the shower space is being closed from the outside, thereby preventing the living space in plane of the installation space from being invaded to optimize the use efficiency of the living space.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be understood that the invention covers all the modifications, equivalents, and replacements within the idea and technical scope of the invention.

What is claimed is:

1. A ceiling-mounted shower booth (1) comprising:

an upper frame unit (2) mounted on top of an installation space;

a lower bottom unit (3) located under the upper frame unit (2) and having a shower pan (31) with an accommodation space whose top is open formed therein to accommodate water falling down thereabove and a drain hole (313) formed on a given position thereof to drain the water to the outside, the shower pan (31) being formed more curvedly upward from the center thereof than the corners thereof;

an ascending and descending unit (4) adapted to selectively move the lower bottom unit (3) so that the lower bottom unit (3) becomes close to and distant from the upper frame unit (2) and comprising ascending and descending wires (41) whose ends are fastened to the lower bottom unit (3) and passing through the upper frame unit (2), an ascending and descending wire winding drum (42) for winding the ascending and descending wires (41) thereon, and an ascending and descending member (43) for selectively rotating the ascending and descending wire winding drum (42) forward and backward to allow the ascending and descending wires (41) to be wound and unwound on and from the ascending and descending wire winding drum (42); and a closing curtain unit (7) having curtains (71) movably fastened to the upper frame unit (2) to close the space between the upper frame unit (2) and the lower bottom unit (3) from the outside, wherein the upper frame unit (2) is provided by coupling frame pipes (21) whose interiors are hollow as square pipes whose sectional shapes are square to one another, and the ascending and descending wires (41) pass through the interiors of the frame pipes (21) and are thus wound on the ascending and descending wire winding drum (42), the frame pipes (21) having a plurality of guide rollers (44) located therein to inducedly guide the ascending and descending wires (41), the ascending and descending wires (41) being provided with four wires in one set that have ends fixed to four corners of the shower pan (31), the frame pipes (21) each having an introduction opening (93) adapted to pass the corresponding ascending and descending wire (41) and the corresponding curtain (71) therethrough, and the introduction opening (93) having a water removal filter (94) disposed thereon to suckedly or pushedly remove the water remaining on the corresponding curtain (71) when the curtain (71) enters the introduction opening (93).

* * * * *